United States Patent [19]

Deeg

[11] Patent Number: 4,621,452

[45] Date of Patent: Nov. 11, 1986

[54] POWERED SLIDING DOOR SAFETY SYSTEM

[76] Inventor: Wyman L. Deeg, 2604 Raynell Dr., San Diego, Calif. 92123

[21] Appl. No.: 692,535

[22] Filed: Jan. 18, 1985

[51] Int. Cl.[4] ..... E05F 15/20

[52] U.S. Cl. ..... 49/28; 49/25; 187/52 R

[58] Field of Search ..... 49/28, 26, 25, 31; 187/52 R, 52 LC

[56] References Cited

U.S. PATENT DOCUMENTS

| | | | |
|---|---|---|---|
| Re. 30,719 | 8/1981 | Mills | 49/25 X |
| 3,852,592 | 12/1974 | Scoville et al. . | |
| 3,857,466 | 12/1974 | Berkovitz | 49/25 X |
| 3,868,000 | 2/1975 | Spear | 49/25 X |
| 3,903,996 | 9/1975 | Berkovitz | 49/25 X |
| 3,946,241 | 3/1976 | Malinowski . | |
| 4,107,522 | 8/1978 | Walter . | |
| 4,274,226 | 6/1981 | Evans | 49/26 X |
| 4,310,756 | 1/1982 | Sick et al. . | |
| 4,317,992 | 3/1982 | Stauffer . | |
| 4,376,971 | 3/1983 | Landgraf et al. | 49/28 X |
| 4,452,009 | 6/1984 | Baumeler et al. | 49/28 |
| 4,458,146 | 7/1984 | Reiner et al. . | |

FOREIGN PATENT DOCUMENTS 3021363 12/1981 Fed. Rep. of Germany ..... 49/28

*Primary Examiner*—Peter A. Aschenbrenner

*Attorney, Agent, or Firm*—Brown, Martin, Haller & Meador

[57] ABSTRACT

A sliding door having a safety light beam which travels with and ahead of a closing door. Interruption of the safety light beam by an object in the path of the closing door activates a door control to stop or reverse the closure of the door. A stationary transmitter projects a beam of pulsed infrared light to a convex mirror mounted on the door. The mirror reflects the projected beam ahead of the closing door in a direction transverse to the direction of closure. In one embodiment a plurality of receiver assemblies with overlapping receiving sectors monitor the door closure path and sense the presence of the moving safety beam. Interruption of the safety light beam is detected in a control unit connected to a unit which controls a motor that moves the door. In another embodiment, plane mirrors positioned on an arm mounted on, and projecting ahead of the door, establish and reflect safety beams to corresponding receiver assemblies.

5 Claims, 12 Drawing Figures

POWERED SLIDING DOOR SAFETY SYSTEM

BACKGROUND OF THE INVENTION

This invention relates to the control of automatically operated sliding doors, and more particularly to providing improved safety control for such doors to prevent door contact with persons or objects in the path of the door.

Automatically controlled power driven sliding doors are in wide use for entry into buildings, rooms, elevators and the like. The extensive use of such doors is fostered by their intrinsic utility and convenience as well as their space-saving features. Since a sliding door operates in the plane of the entrance, problems of providing additional space for a swinging door, as well as potential contact with transistors by a swinging door are avoided.

In the usual automatic sliding door installation, the opening of the door is initiated by sensors installed to monitor the approaches to the door. One method commonly used is to employ a movement detecting device such as a doppler sensor that detects the approach of transitors to initiate opening, or cycle the door to reopen it if it is in the process of closing. The door power controls are equipped with time delays that permit transit of persons and object transistors before automatically initiating a close cycle. Another method frequently used to initiate the action of the door is a pressure mat installed in front of the entrance. The weight of a transitor upon the mat activates the door to an open position and holds it open as long as the pressure is maintained. A third method is from a request storage control such as in an elevator.

Although a sliding door operates in the plane of the opening, and thus avoids potential contact with the transitor due to the door's swinging action, the automatic closing of the door upon a person presents a hazard. For example, should the transitor pause and present no movement to the opening sensor the door will cycle closed. Even though the movement sensor is associated with a mat, with use and wear the pressure sensing features may no longer function, and thus the door will again cycle closed. A usual additional safety feature to provide against such unwanted closure and contact is the provision of one or more safety beams across the lower portion of the door opening which if interrupted by the presence of a transitor will cause the door to remain open. Despite the above safety features, the hazards of door closing contact upon a person or object still exists in the usual installation. This hazard is particularly applicable to elderly persons or those having ambulatory handicaps who may pause at the door entrance without interrupting the safety beams. An example would be a person using a walker who hesitates at the door. If the legs of the walker straddle the safety beam and the pressure mat is ineffective, the door will close upon the walker or the person at the end of the door delay. It is desirable, therefore, to provide automatic operating sliding doors with a safety feature that will prevent closing of the door or interrupt its closing cycle by the presence of an object or person in the plane of the door. It is desirable for such a safety feature to be effective and reliable, yet be inconspicuous, simple in operation, and relatively inexpensive. Applicant's invention meets these and other requirements.

SUMMARY OF THE INVENTION

According to the precepts of the invention a stationary pulsed infrared light transmitter is positioned adjacent to the closed jamb of a sliding door near floor level. The transmitter projects a collimated horizontal light beam parallel to the door closure path and the floor. The projected light beam is received by a convex mirror mounted adjacent to the leading edge of the sliding door. The convex mirror reflects the projected light beam in a selected sector, or arc of light rays oriented upwardly and ahead of the leading edge of the moving door. The sector of reflected rays continuously travels ahead of the leading edge of the moving door.

In accordance with further precepts of the invention, the door opening ahead of the sliding door is monitored by light receiving assemblies which detect the presence of one or more active safety beams which move with and lead the door by a predetermined distance. Interruption of the moving safety beam by an object causes the door to be held open or be re-cycled to an open position.

In a first illustrated embodiment, the safety beam is established by a series of equally spaced stationary light energy receiver assemblies, the sensors of which are phototransistors. The receiver assemblies are positioned along the door header and oriented downwardly and toward the open position of the sliding door at a selected angle. Each of the receiver sensors is masked by a rectangular opening of selected dimension to provide a scanned sector of the door opening of precise dimensions. Sectors of adjacent receiver assemblies are designed to overlap, and alternate adjacent sectors also overlap at the level of the horizontally projected transmitter beam. Thus, continuous and progressive coverage of the sliding door opening is provided by the receivers to indicate the location of the wide angled mirror and thus the door edge in a particular sector.

Active safety light beams received by the receiver assemblies are converted to pulsed electrical signals in receiver detector units. Alternate adjacent receiver outputs are electrically coupled together, amplified, and integrated. In the illustrated embodiment, gates sequentially actuated by a pulse generator, which also controls the light transmitter, are employed to improve signal to noise ratio. The gates of each integrator input are sequentially opened by the transmitter control pulse on each transmission. If two or more pulses are not received by each integrator, an integrator output voltage results. The later voltage energizes a transistor in the door safety control which in turn causes a relay in the door operating control to function and hold open or recycle the door open.

The versatility of the invention is illustrated in a second embodiment for use with double leaf sliding doors. In this embodiment, the elements and arrangement of the first-described embodiment are provided for each door with certain elements being shared. A single pulsed light transmitter projects a horizontal beam toward convex mirrors positioned adjacent to the leading edge of each of the doors. The mirrors reflect the projected beam as divergent sectors of light upwardly and ahead of each door. Two sets of light receiver assemblies spaced along the door header monitor moving active safety light beams leading each door. The receiver assemblies and control circuitry for the second illustrated embodiment are essentially duplicated versions of the first illustrated embodiment to control the movement of each door.

In a third illustrated embodiment, the reflected rays of a convex mirror are received by two spaced plane mirrors mounted one above the other on an arm attached at the upper part of the sliding door and extending in the direction of door travel. The plane mirrors are mounted at appropriate angle from the vertical and further reflect the direct rays from the convex mirror horizontally to a pair of stationary receivers positioned at the top of the open door jamb. The horizontal and vertical positions of the plane mirrors with relation to the wide angle mirror are deisgned to provide two safety light beams leading the door edge to intercept objects in the path of the moving door.

The primary advantage of the invention is the provision of a new and improved powered sliding door safety system for preventing contact of the door with an object in its path. The usually found horizontal safety beam for protection at a door entrance is provided. In addition, the system provides substantially full coverage of the door opening by a safety light beam proceeding the leading edge of the door. By this means greatly enhanced protection is provided. The design causes the moving door to be held opened or recycled to an open position by the presence of an object that interrupts the moving safety light beam. Thus protection is afforded should a cane or walker of an elderly or handicapped person project through the door without interrupting the horizontal safety beam. The system is capable of detecting objects of small dimensions, is fully automatic in operation, and does not require switches or other moving parts. The system is adaptable to the configuration of usually employed powered sliding doors without extensive modification or installation of equipment affecting approaches to the door. The mounted components of the system are unobtrusive. The simplicity of the design and the absence of moving parts contribute to system reliability. Should maintenance be required, however, access to the components is easily achieved. The design of the safety system is readily adaptable to single or double leaf sliding doors. These and other advantages will become more apparent when considering the details of construction and operation of the safety system as they are more fully described. Reference will be made to the accompanying drawings wherein like numerals refer to like parts throughout.

DETAILED DESCRIPTION OF THE DRAWINGS

Figure 1:
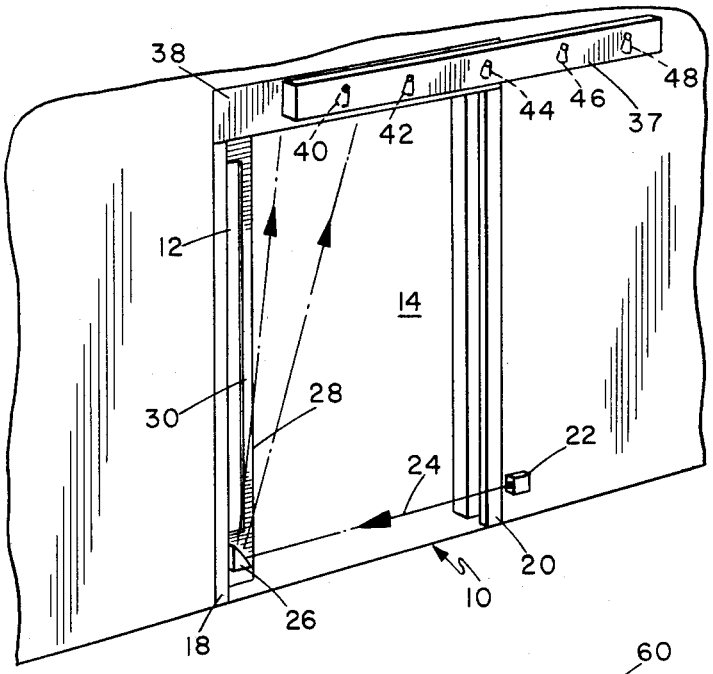
FIG. 1 is a perspective view of a typical doorway with the safety system installed.
Figure 2:
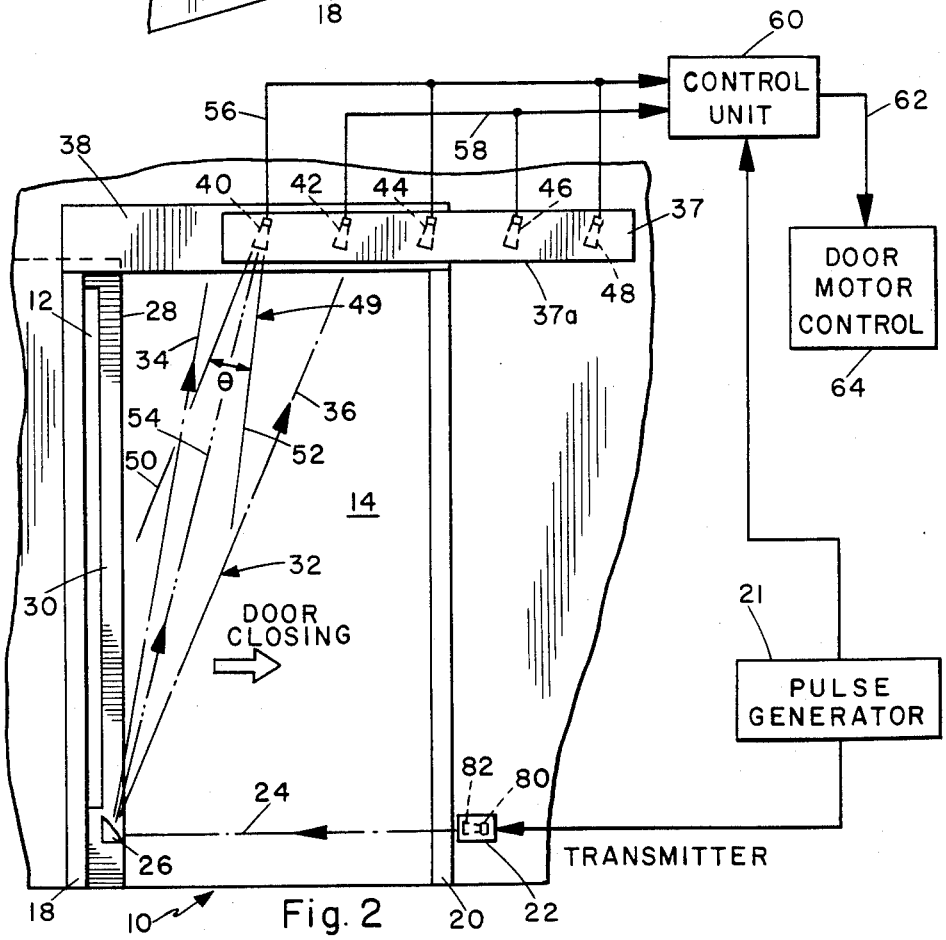
FIG. 2 is a front view of the doorway of FIG. 1 with a block diagram of the control system.

The first illustrated embodiment of the safety system 10 is illustrated in FIGS. 1 and 2 as it would be employed with a single leaf powered sliding door. The depicted door 12 opens and closes a door opening 14 between the door jambs 18 and 20. The power source and components that cause the door motion are not shown, nor is the sensing means employed to cause the door to open for someone desiring to transit the opening 14.

The major components of the system 10 include a pulse generator 21 for producing short duration electrical pulses of high current which are used to energize a light beam transmitter 22 to produce a beam 24 of pulsed infrared light. For the purposes of this description light pulses with a repetition rate of at least 120 pulses per second are used in conjunction with a detection time constant not greater than 3 pulse intervals. Using these parameters with a door having a closing speed of up to 1.66 ft per second, a one-half inch object will be detected by the system 10. A lesser detection time constant or higher pulse repetition rate may be used for faster response if desired. A representative sliding door has a height of 7 feet. In the installation illustrated, a light transmitter 22 is located adjacent the door jamb 20 at a height of 6 inches above the floor and projects a beam 24 horizontally to a convex mirror 26 mounted adjacent to the leading edge 28 of the door frame 30. The beam 24 is parallel to the plane of the door travel and provides the usual horizontal safety beam in the system 10. The mirror 26 reflects and spreads the pulsed beam of light 24 upwardly to provide a sector 32 of reflected light that sweeps ahead ofthe travelling door edge 28. The lines 34 and 36 represent the outer limits of the light sector 32. The angular width of the sector 32 is selected to provide reflected light covering twice the linear distance between any two of a set of equally-spaced receiver assemblies 40 through 48 located in a receiver housing 37. Stated differently, the sector 32 is wide enough to illuminate, at the plane surface 37*a*, at least two but no more than three of the asesmblies 40–48.

Therefore, as the door 12 is closed and the leading edge 28 of the door moves from the jam 18 to the jam 20, the five receiver assemblies are illuminated as follows:

40 and 42
40, 42 and 44
42 and 44
42, 44 and 46
44 and 46
44, 46 and 48
46 and 48

Receiver assemblies 40, 42, 44, 46, and 48 are contained in a housing 37 which is mounted on and extends beyond the door header 38. The assemblies are mounted in a housing 37 adjacent a lower housing surface 37*a* that forms a plane illuminated by the sector 32. In the installation illustrated, five receiver assemblies are employed, but the number of receiver assemblies will vary depending upon the width of the door opening to be protected. The receiver assemblies are equally spaced 11 inches apart, and each receiver assembly monitors a precise light receiving field-of-view 49 of the door closure path as depicted by lines 50 and 52 emanating from the receiver assembly 40. The fields-of-view of adjacent, and alternate adjacent receiver assemblies overlap at the level of beam 24 such that continuous coverage of the door closure path is provided by the five receiver assemblies as the illumination sector 32 moves ahead of the door 12.

The cooperative relationship between the moving reflected illumination sector 32 and a typical light receiving field-of-view 49 is illustrated in FIG. 2. In FIG. 2 the door 12 is illustrated in the fully opened position. The reflected light sector 32 from the mirror 26 illuminates the receiver assembly 40 and 42. This results in light beam 54 directly between the mirror 26 and the receiver assembly 40 which traverses the light receiving field-of-view 49 as the door moves toward a closed position. The minimum protection distance from the door leading edge 28 is determined by the size of the viewing angle theta and its position relative to vertical. The pulsed light energy of beam 54 sensed by the receiver assembly 40 is converted by phototransistors, not shown, of the receiver assembly 40 into an electrical response signal that is transmitted by signal lead 56 to a control unit 60. Similarly, the assemblies 44 and 48 are connected to the signal lead 56. The receiver assemblies 42 and 56 are connected via a signal lead 58 to the control unit 60.

The control unit 60 monitors the presence of the response signals generated by the receiver assemblies when they are illuminated by the beam 54. Interruption of the beam 54 by an object in the beam's path causes loss of a response signal on one or both of the leads 56 or 58. When it detects the loss of a response signal on either of the leads,the control unit transmits a stop signal on lead 62 to a door motor control unit 64, that causes the unit 64 to hold open or recycle open the door 12.

Figure 3:
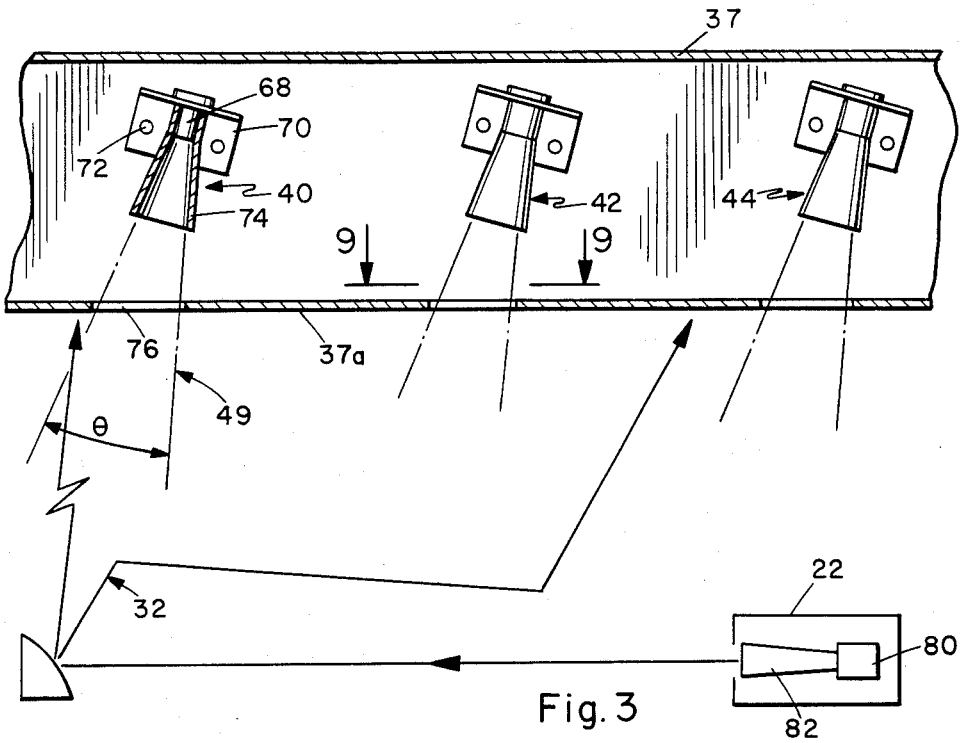
FIG. 3 is an enlarged cutaway view of the receiver housing showing some of the receiver assemblies and their relationship to the reflected light beam sector.

The details of construction of the receiver assemblies and their relationship with the reflected light sector 32 are further depicted schematically in FIG. 3. The essential features of the several receiver assemblies are the same, and therefore may be understood with reference to receiver assembly 40. A light detecting unit 68 is rigidly mounted in an L-shaped bracket 70 which in turn is secured in the housing 37 with suitable fasteners 72. Each detecting unit 68 is mounted at an appropriate angle from the vertical, which in the embodiment illustrated is 16 degrees, and toward the open position of the door. A concentrator 74 with a reflective inner surface is provided the receiving unit 68 to intensify the received light directed to the receiver unit. The concentrator 74 has the form of a truncated cone with a reflective interior surface. In the described embodiment, the concentrator 74 is formed of aluminized mylar.

To establish a well defined receiver assembly viewing angle theta and boundaries for the light receiving field-of-view 49 a rectangular aperture 76 in the lower housing surface **37*a* below and centered on the center line of the detector unit 68 is employed. The surface 37*a* forms a plane illuminated by the illumination sector 32**. The apertures permit illumination to pass through the plane and irradiate the receiver assemblies. It should be evident that the receiver assemblies could be mounted in the plane itself.

Figure 9:
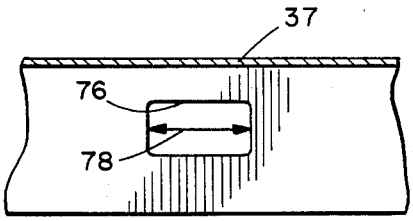
FIG. 9 is a sectional view taken on line 9—9 of FIG. 3.
Figure 10:
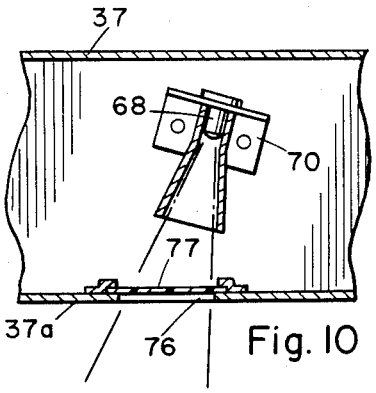
FIG. 10 is a view similar to a portion of FIG. 3, showing an alternative filter for a receiver assembly.

The aperture 76 is further illustrated in FIG. 9. It has an appropriate aperture length, which in the embodiment shown is one inch, and is designed in cooperation with the other parameters to establish a viewing angle theta of 8–23 degrees from the vertical toward the open position of the door as well as the necessary overlap between receiver assembly receiving sectors 49 for coverage of the door opening 14. A variation of a receiver assembly suitable for use in high ambient light installations is illustrated in FIG. 10. In the latter construction, a filter 77 passing infrared light covers the aperture 76.

As also depicted in FIG. 3, the light beam transmitter 22 includes a light emitter unit 80 consisting of multiple light emitting diodes, not shown. The emitter unit 80 is provided with a light collimator 82. The collimator 82 has a truncated conical shape with an interior reflective surface and is formed of aluminized mylar for the purpose of intensifying the transmitted beam.

Figure 4:
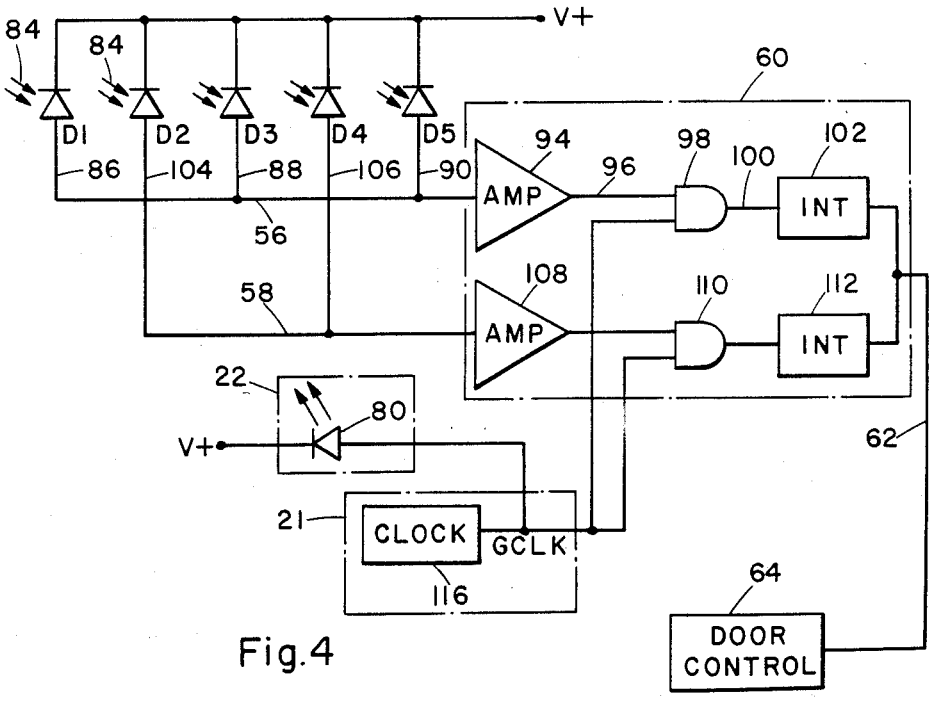
FIG. 4 is a schematic of the control circuitry for the installation of FIGS. 1–3.

A schematic representation of the circuitry of the light receiver assemblies 40 through 48, the pulse generator 21, the control unit 60, and the light transmitter 22 is illustrated in FIG. 4. Letter numeral designations D1 through D5 represent the light detector units of the receiver assemblies 40–48, respectively. The arrows 84 represent the receipt of illumination from the illumination sector 32, as the detectors are illuminated in the sequence described above as the door closes. When illuminated by a light beam, alternate adjacent detector units D1, D3 and D5 produce electrical response signals that are coupled, through signal leads 86, 88, and 90, to the signal lead 56. The received electrical pulses on the lead 56 are amplified by an amplifier 94 and coupled by lead 96 to a gate 98, and then by lead 100 to an integrator 102. Similarly, the response signals output by detector units D2 and D4 are coupled through leads 104 and 106 to the lead 58. The response signals on the lead 58 are amplified, gated and integrated in the amplifier 108, gate 110, and the integrator 112.

In operation, the detectors D1–D5 are illuminated by the sector 32 in sequence, as described above. Since members of one group of detectors, including D1, D3, and D5, alternate with members of another group of detectors, including D2 and D4, a sequence of response signals will be continually present on the leads 56 and 58 as the illumination sector sweeps across the detectors. However, when, during closure of the door, enough of the sector is interrupted to block illumination of at least one of the detectors having the sector in its field-of-view, the response signal sequence on the lead to which the detector is connected will be interrupted. If the interruption exceeds a present duration, the control unit will produce the stop signal.

The sweeping of the detectors D1, D3, and D5 by the illumination sector 32 will produce a sequence of response signal pulses having the frequency of the pulses transmitted by the transmitter 22. This sequence will be fed to the amplifier 94 on the signal lead 56. Similarly, the detectors D2 and D4 will cause a response signal sequence to be fed to the amplifier 108. In operation, the control unit 60 searches for pulses on each of the lines 56 and 58.

The positive GCLK signal admits every response pulse from the signal line 56 to the input node of integrator 102; similarly, GCLK admits signal pulses to the integrator 112. Both integrators have integration time constants equal to 3 times the clock interval of CLK. This enables each integrator to maintain an output above a certain preset level so long as response pulses are present. However, should blockage of the illumination sector 32 cause an illuminated receiver assembly to fail to produce a response pulse when the signal line to which the assembly is connected is gated to its respective integrator, the integrator output will fall below its preset level. If two or more pulses are not received by each of the integrators 102 and 112, a high current output results on lead 118 which is coupled to and activates the door control 64 to open or recycle open the door 12.

Figure 5:
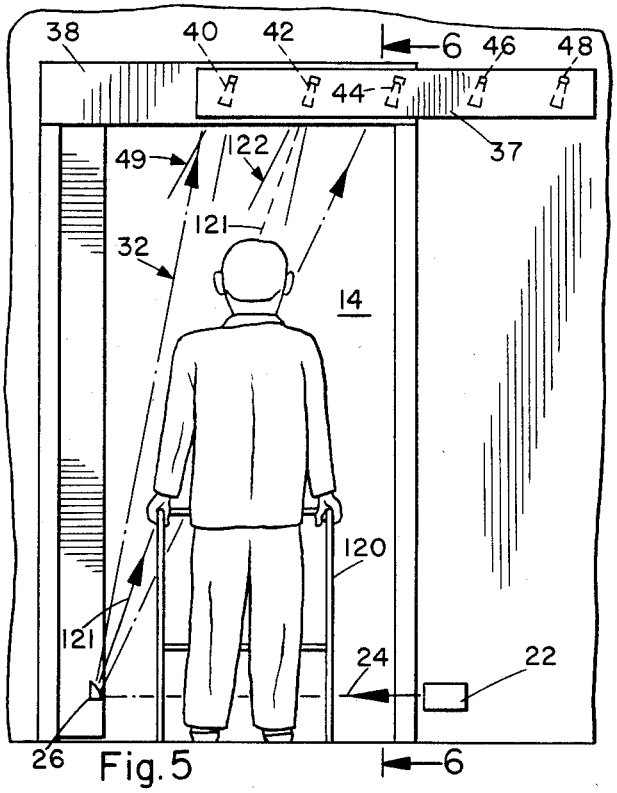
FIG. 5 illustrates the detection of an obstacle by the system.
Figure 6:
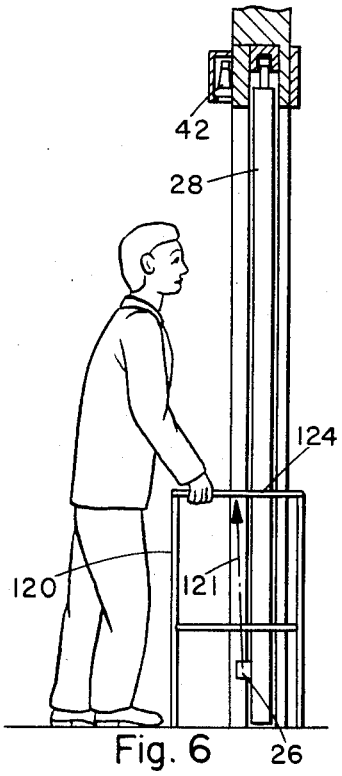
FIG. 6 is a sectional view taken on line 6—6 of FIG. 5.

The particular protection afforded by the safety system 10 is depicted in FIGS. 5 and 6 which illustrate a person using a walker 120 about to transit the door opening 14. The walker is in the door opening 14, but the presence of the walker would not be sensed by the beam 24 since none of the walker components obstruct the beam 24. However, the reflected light of the sector 32 is being received by the receiver assemblies 40 and 42, and an active safety light beam 121 within the receiving sector 122 of receiver assembly 42 will be interrupted by the presence of the upper gripping bar 124 of the walker to hold the door open.

Figure 8:
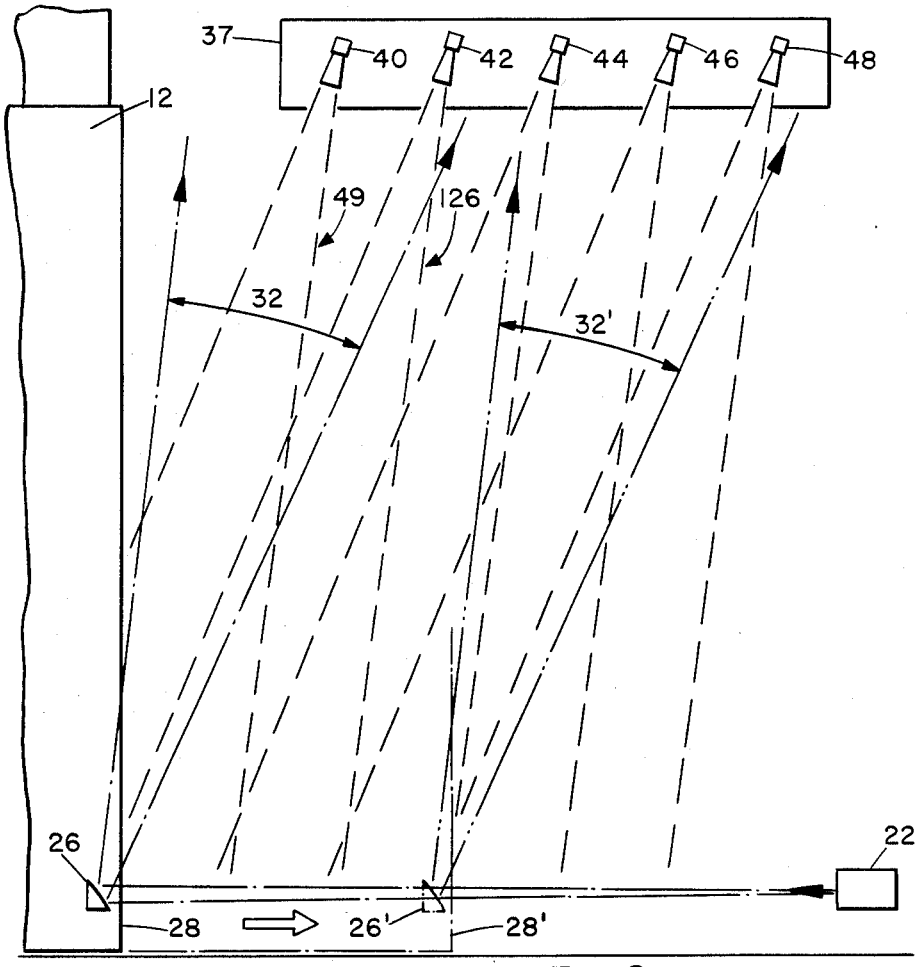
FIG. 8 illustrates diagrammatically the advancement of a safety light beam across the door closure path.

The progressive interaction of the reflected light sector 32 and the light receiving sectors of the receiver assemblies as the door 12 closes is illustrated in FIG. 8. The reflected light sector 32 is illustrated in the door open position and spanning two receiving assemblies at the level of the door header 38. As a result, the light from the mirror 26 will be within the light receiving sectors 49 and 126 of receiver assemblies 40 and 42 respectively, and detect an active safety beam leading the door edge 28 in each sector. As the door 12 moves across the door opening 14, the reflected light of sector 32 is progressively detected by 2 or 3 receiver assemblies due to the overlapping of their light receiving sector. For example, at the position of the mirror 26', the reflected light of the sector 32' is within the light receiving sectors of the receiver assemblies 44, 46 and 48. At this door position, although receivers 44 and 48 will be receiving light pulses, an interruption of light to receiver 48 by an object in the door path will not be detected since the signal outputs of receivers 44 and 48 on line 56 are in parallel as shown on FIG. 4. At this time, however, receiver 46 on line 58 is singularly active and will detect the object as the door continues to close.

Figure 7:
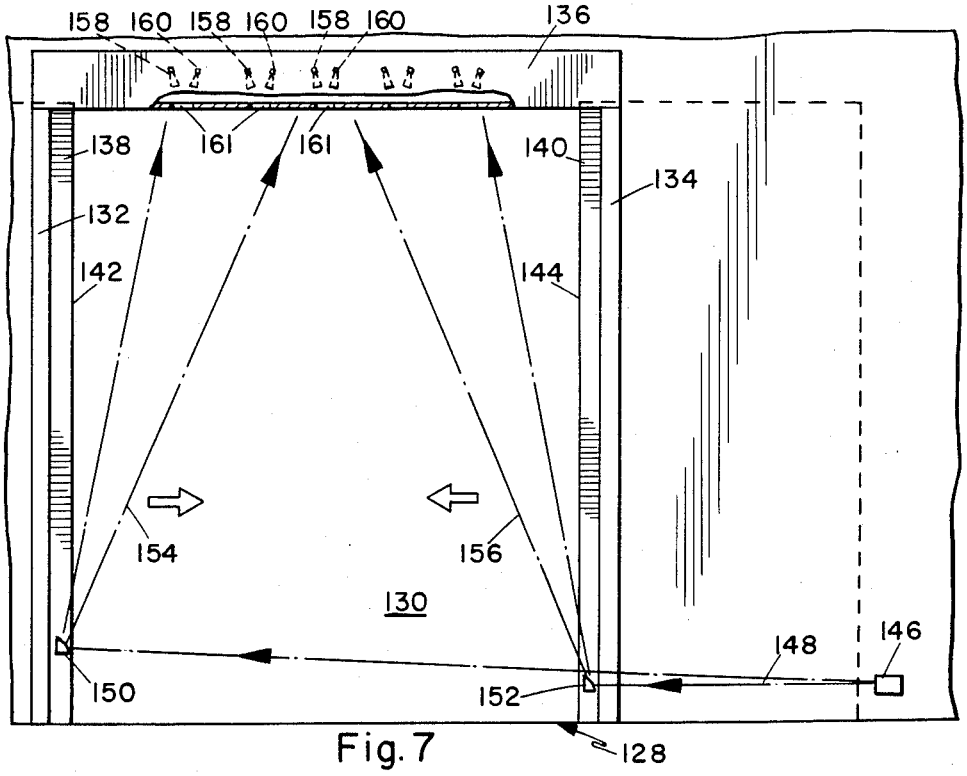
FIG. 7 is a front view of a doorway with the system adapted to double sliding doors.

A second embodiment of the invention is illustrated in FIG. 7. The embodiment depicts the safety system as it would be employed with a double-leaf door installation 128. The door opening 130 is enclosed by door jambs 132 and 134, and the door header 136. The left door 138 and the right door 140, as shown in the figure, close toward one another with their respective leading edges 142 and 144 meeting in the center of the door opening 130 to close the opening.

The individual components of the safety system employed in the double door installation 128 are the same as previously described for the first embodiment. The door opening 130 is protected by providing essentially a duplicate of the first embodiment of the invention for each of the doors 138 and 140, but with shared elements.

A single light transmitter 146 projects a light beam 148 across the door opening 130. Convex mirrors 150 and 152 mounted on the doors adjacent the leading edges 142 and 144 receive and reflect the beam as divergent sectors 154 and 156 leading the door edges as in the first embodiment. The mirrors 150 and 152 are mounted with a small difference in height above the floor to be able to receive and reflect the light of beam 148. The travel of the light sectors 154 and 156 as the doors are closed is monitored by five spaced receiver assemblies for each door mounted in pairs, and located on the door header 136. Receiver assemblies 158 are oriented toward the right door 140, and monitor the progress of the light sector 156, while the receiver assemblies 160 monitor the moving light sector 154 of the left door. The pairs of receiver assemblies 158 and 160 share common apertures 161 for defining the light receiving sectors of the receiver assemblies. The control circuitry for the double door installation is not shown, but as in the first embodiment, each of the doors is provided with control circuitry as illustrated in FIGS. 2 and 4. However, the outputs of the control units are interconnected such that an interruption of any beam from either door results in an output signal to a door control to open or hold open the doors.

Figure 11:
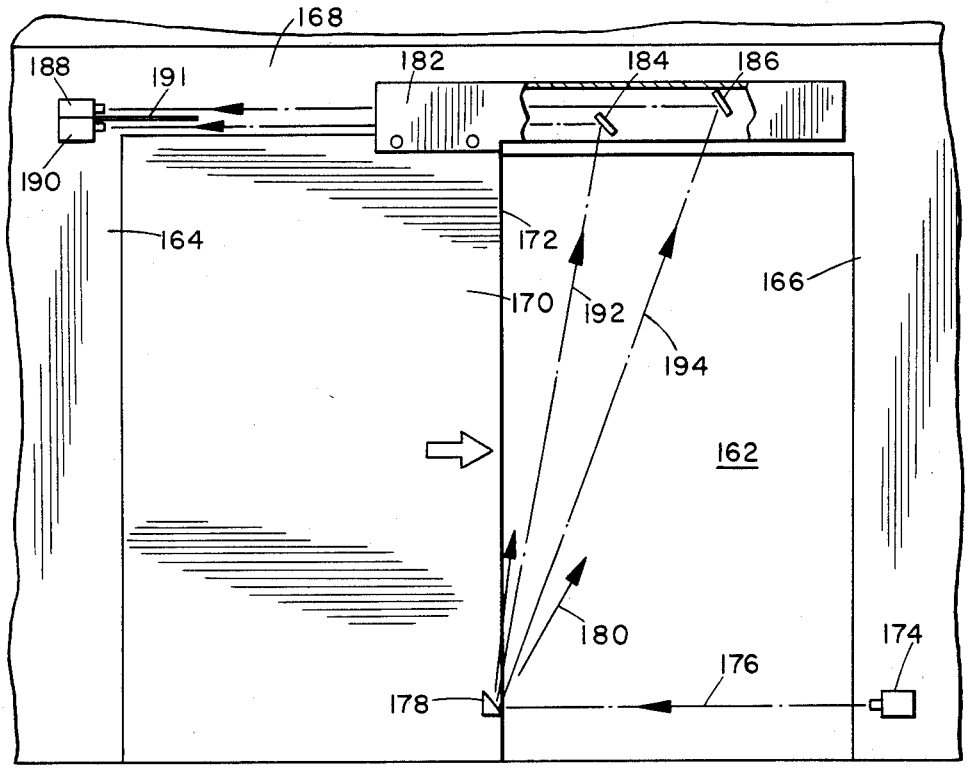
FIG. 11 is a front view, partially cut away, of an alternative installation.

A third embodiment of the invention is illustrated in FIG. 11. In this modification, two active safety beams lead the sliding door by predetermined distances. As depicted in FIG. 11, the door opening 162 is formed by door jambs 164 and 166 and a door header 168. The door 170 closes from left to right in the drawing by sliding from an open position with the leading edge 172 of the door adjacent to the jamb 164 to a closed position with the leading edge 172 adjacent to the jamb 166. As in the first embodiment, a light transmitter 174 positioned near floor level transmits a light beam 176 horizontally to a convex mirror 178 mounted on the door 170 adjacent the leading edge 172. The mirror 178 reflects the beam 176 as a divergent sector of light 180 upwardly and ahead of the leading edge of the door.

The door 170 is provided with an arm 182 mounted at top of the door and extending ahead of the leading edge 172 of the door. To establish the active safety beams in this embodiment, two plane mirrors 184 and 186 are mounted on the arm at an appropriate angle from the vertical to reflect light received to one of two receiver assemblies 188 and 190 mounted adjacent to the door jamb 164. A shield 191 is mounted between the receiver assemblies to prevent interference between the reflected light beams being received. The reflected light sector 180 of the mirror 178 spans the plane mirrors 184 and 186. Active safety beams 192 and 194 represent the light from the convex mirror 178 that is reflected by the plane mirrors to the receiver assemblies. The position of the active safety beams 192 and 194 ahead of the door leading edge 172 is determined by the location of the plane mirrors on the arm 182 in relation to the vertical height of the mirrors above the beam 176 and the horizontal distance of the mirrors from the convex mirror 178. Based upon mirror 186 being 78 inches above the beam 176 and displaced horizontally 41 inches from the center of the mirror 178, the active safety beam 194 will lead the door edge 172 by 30 degrees. In the installation being described, mirror 184 is positioned 76 inches above the beam 176 and 30 inches horizontally from the center of mirror 178, and leads the door edge by 20 degrees. With this configuration, at a height of 36 inches above floor level, the maximum height of a typical walker, active safety beam 194 would lead the door edge 172 by approximately 10½ inches, and active safety beam 192 would lead the door edge by 4½ inches. Two active beams are used to more completely cover the door opening 162. Beam 194 will sweep the entire area to the right as the door closes. Beam 192 will protect the door opening nearer the door leading edge 172. The combination of beams 192 and 194 provides protection while allowing for adequate response time for the door control 218.

Figure 12:
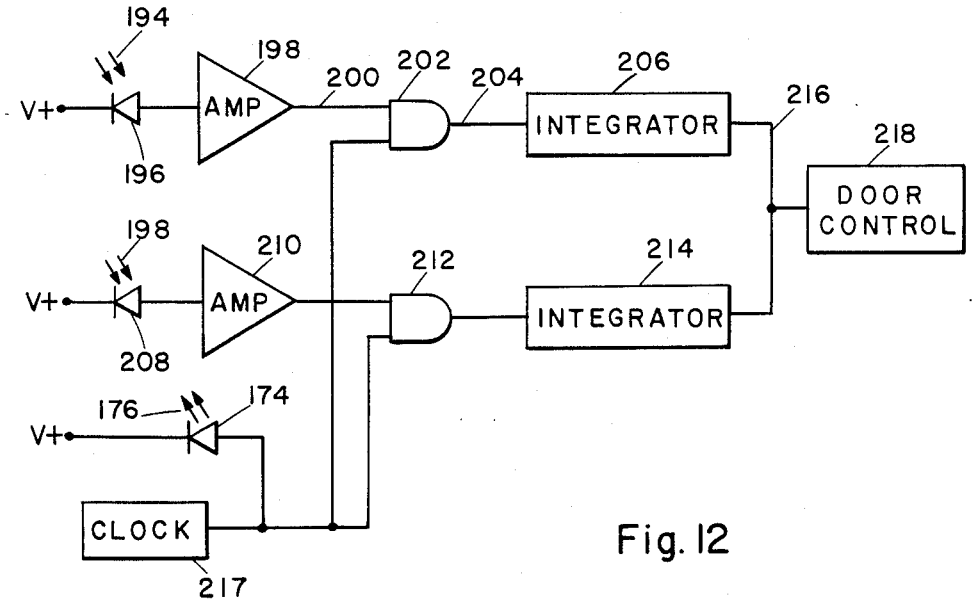
FIG. 12 is a schematic of the control circuitry of the system of FIG. 11.

The control circuitry for the embodiment of FIG. 11 is illustrated in FIG. 12. The arrows represent the receipt of the reflected active safety beams 194 and 192 by the receiver asemblies 188 and 190 respectively. The beam 194 is converted to electrical pulses by the receiver detector unit 196. The electrical output of the detector unit 196 is amplified by the amplifier 198 and coupled by lead 200 to a gate 202 and by lead 204 to an integrated 206. Similarly, the electrical output of detector unit 208 is amplified, gated and integrated in amplifier 210, gate 212 and the integrator 214. Synchronous gating of the electrical signals in employed as in the first described embodiment to improve the signal noise ratio of the system. The time constant of the integrators 206 and 214 is equal to three times the interval between light pulses of the transmitter 174 represented by the clock 220. If two or move pulses are not received by each of the integrators, a high current output results on lead 216 which activates the door control 218 to open the door 170.

OPERATION

The operation of the powered sliding door safety system will be described with reference to FIGS. 2, 4 and 5. In FIG. 5, a person using a walker 120 in transitting the door opening 14 is illustrated. The walker is in the door closure path, but due to the construction and position of the walker, it does not interrupt the horizontal beam 24 of the system to stop the closure of the door 12. However, the active safety light beam 121 is being received by receiver assemblies 40 and 42 as the reflected light sector 32 moves with the closing door. The active safety light beam received by receiver assembly 40 will not be interrupted by the person or the walker, but safety light beam 121 is interrupted by the upper gripping bar 124 of the walker. Since no safety light beam is yet being received by the detector D4 of receiver assembly 46, interruption of the beam 121 will result in no detection signal being received on bus 58 (FIG. 4). As a result, the integrator 112 will have a high current output to activate the door control 64 to open or recycle open the door.

Having described my invention, what is claimed is:

1. A safety system for powered sliding doors which close a door opening by using door moving means for slideably moving a leading edge of a door across the door opening to a closed position comprising:

transmitter means mounted adjacent the door opening in a stationary manner for projecting a beam of energy in a predetermined illuminating pattern from a side of said door opening adjacent said closed position across the door opening toward the leading edge in a direction approximately parallel to the direction of movement of said door;

reflecting means mounted on the door adjacent said leading edge for reflecting the energy beam projected by the transmitter means toward an edge of the door opening, along a direction transverse to the direction of movement for said door; and energy detecting means secured in a stationary manner adjacent said door opening so as to receive said redirected beam of energy, while the door is closing.

2. The system of claim 1 wherein:

the detecting means includes a plurality of energy detectors disposed in a linear array adjacent a path of illumination traversed by the illuminating pattern, each providing a response signal when contained in the pattern, and the plurality of detectors includes a first group of alternate detectors that includes one of the pair of detectors, and a second group of detectors, including the other one of the pair of detectors, each detector in the second group alternating along the path traversed by the illuminating beam with one of the first group of detectors; and a circuit means including a first signal path means connected to the first group of detectors for detecting when none of the first group of detectors produces a respective response signal while the door is closing and the second signal path means connected to the second group of detectors for detecting when none of the second group of detectors produces a response signal while the door is closing.

3. The system of claim 2 wherein the plurality of detectors are disposed in such a spaced relationship that at least two, but no more than three of them, are illuminated at any instant while the door is closing.

4. A method for stopping the closure of automatically operated powered sliding doors which close a door opening by using door moving means for slideably moving a leading edge of a door across the door opening to a closed position, comprising the steps of:

projecting an energy beam across the open portion of the door opening toward said leading edge substantially parallel to the direction of movement for the leading edge of the door from a source fixed in a stationary manner adjacent the door opening;

reflecting said energy beam from reflection means secured to said door into a direction transverse to the direction of movement of said door and through a position a predetermined distance in front of the leading edge while the door is being closed;

detecting an interruption of the projected light arriving at an energy detection means secured in a stationary manner adjacent said door opening, while the door is closing; and providing a stop signal to said door moving means.

5. The system of claim 1 wherein said reflection means comprises a spherical mirror.

* * * * *